United States Patent [19]

Kelly et al.

[11] 4,239,490

[45] Dec. 16, 1980

[54] CARPET DYEING SYSTEM

[75] Inventors: David Kelly, Dalton, Ga.; Michael Vidal, Lakeworth, Fla.; Saul Rosenthal, Dalton, Ga.

[73] Assignee: Professional Chemical & Color, Inc., Dalton, Ga.

[21] Appl. No.: 21,223

[22] Filed: Mar. 16, 1979

[51] Int. Cl.[3] ..... D06P 00/00; D06P 1/38

[52] U.S. Cl. ..... 8/499; 8/516; 8/929

[58] Field of Search ..... 8/1 XB, 18 R

[56] References Cited

U.S. PATENT DOCUMENTS

| | | | |
|---|---|---|---|
| 3,317,271 | 5/1967 | Mecco | 8/1 XB |
| 3,562,844 | 2/1971 | Thompson et al. | 8/1 XB |
| 3,802,836 | 4/1974 | Speck | 8/1 XB |
| 4,098,570 | 7/1978 | Skelly et al. | 8/1 XB |
| 4,125,368 | 11/1978 | Stingl et al. | 8/1 XB |

FOREIGN PATENT DOCUMENTS

| | | | |
|---|---|---|---|
| 2318718 | 10/1974 | Fed. Rep. of Germany | 8/1 XB |

*Primary Examiner*—William F. Hamrock

[57] ABSTRACT

A method of dyeing a tufted pile carpet on location. The method comprises the steps of spraying a dye liquor onto the pile of the carpet, spraying a sealer onto the pile of the carpet to fix the dye therein and drying the carpet.

3 Claims, 1 Drawing Figure

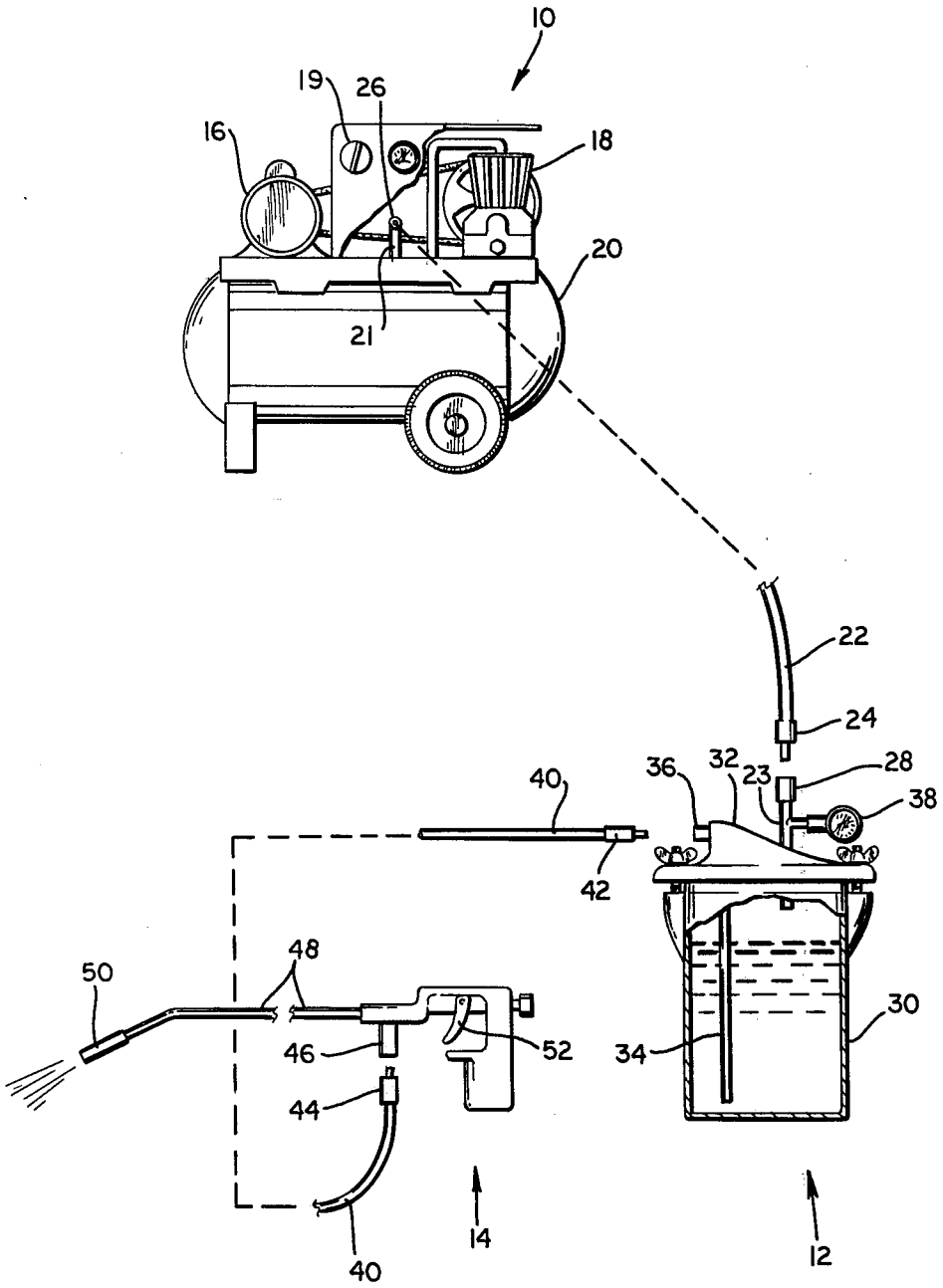
10
19
26
16
18
20
21
22
24
36
32
23
28
38
40
42
48
50
46
52
44
34
30
40
14
12

CARPET DYEING SYSTEM

DESCRIPTION

Field

The present invention relates to a method of dyeing tufted pile carpet, and more particularly, to such a system wherein the carpets are dyed on location.

Background

Carpeting has been made for many years by tufting nylon yarns through a backing material, such as jute, to form a pile on one side of the backing. The nylon yarns may be either predyed before tufting or the carpet pile may be dyed after tufting. Dyeing of such carpeting usually requires the use of controlled heat conditions, dyebath immersion, padroll application and steaming. After a carpet has been cut and installed at a location where it is to be used, providing the conditions necessary for conventionally dyeing the carpet is at least impractical if not virtually impossible. Therefore, in most situations on location dyeing of tufted nylon pile carpeting has not been commercially successful.

One prior method of on location dyeing comprises pouring a salt-based dyestuff onto the pile of the tufted carpeting and scrubbing it into the carpet with a rotary brush. This method, however, results in uneven dyeing and over wetting of the carpet, which can cause shrinkage, rotting, mildew, and odor problems.

BRIEF DESCRIPTION OF THE INVENTION

The present invention generally relates to a method of dyeing tufted pile carpet which has been cut to size and installed on location. More particularly, the method of the present invention comprises the steps of applying a dye liquor to the pile of a carpet in a controlled spray and applying a sealer to the pile of the carpet. Optionally, a water repellant can be sprayed onto the pile of the carpet. The dye liquor which is sprayed on the carpet pile comprises acid, acid premetalized or direct dyes having one or more sulphonic acid reactive groups.

Accordingly, it is an object of the present invention to provide an improved method of dyeing tufted pile carpeting on location.

Another object of the present invention is to provide a method of expediently and inexpensively dyeing tufted pile carpeting on location to form the color of the carpet in a substantially uniform shade.

A further object of the present invention is to provide a method of dyeing tufted pile carpeting which does not result in over wetting of the carpet and thereby avoids or minimizes shrinkage, rotting, mildew and odor problems associated with over wetting.

These and other objects, features and advantages of the present invention will become apparent from a review of the following detailed description of the disclosed embodiment and the appended drawing and claims.

BRIEF DESCRIPTION OF THE DRAWING

The drawing is a pictorial view of a disclosed embodiment of sprayer apparatus used in conjunction with the method of the present invention with portions of the apparatus removed for clarity.

DETAILED DESCRIPTION OF THE DISCLOSED EMBODIMENT

Referring now to the drawing, it will be seen that there is a compressor assembly 10, a spray tank 12 and a spray gun 14. The compressor assembly 10 is of a conventional type and includes an electric motor 16 which drives an air compressor 18 through a belt drive. The air compressed by the compressor 18 is stored in a tank 20. Suitable control apparatus and air pressure gauge 19 are provided to regulate the pressure of the air in the tank 20.

The tank 20 is connected to the spray tank 12 by pipe 21 at tank 20, hose 22 and pipe 23 at spray tank 12. The hose has quick disconnect fittings 24 at each end thereof which mate with quick disconnect fittings 26, 28 at the tnk and the spray tank, respectively. The spray tank 12 comprises a vat 30 for containing a quantity of liquid material and has a removable lid 32. Pipe 23 communicates through lid 32 to the top of vat 30. Another pipe 34 extending through the lid 32 has one end extending into the lower portion of the vat 30 and the other end being equipped with a quick disconnect fitting 36. A pressure gauge 38 communicates with pipe 23 and indicates the pressure of the air delivered to the vat 30 from the compressor 10. It will therefore be appreciated by those skilled in the art that liquid in the vat 30 can be pumped out of the vat through the pipe 34 at a regulated pressure by pneumatic displacement.

A hose 40 having quick disconnect fittings 42, 44 connects the spray gun 14 to the pipe 34 of the spray tank 12. The spray gun 14 has a quick disconnect fitting 46 which mates with the fittings 42, 44 of the hose 40, as does the fitting 36.

The spray gun 14 comprises an elongate barrel 48 having a spray nozzle 50 on one end thereof. The barrel 48 is connected to the hose 40 through a needle valve (not shown) which is actuated by a trigger 52 on the spray gun 14 so that flow of liquid out of the nozzle 50 can be quickly started and stopped by pulling or releasing the trigger. The nozzle 50 is preferably of the type which delivers a flat fan-shaped spray of liquid therefrom. Thus, it will be appreciated that liquids contained in the vat 30 may be sprayed in a patterned spray and at a constant regulated pressure from the spray gun 14.

The method of the present invention is practiced as follows: A tufted nylon pile carpet in a fixed installation, such as a wall-to-wall carpet in a home, is selected for dyeing. A solution of a dyestuff (the composition of which will be discussed in detail hereinbelow) for dyeing the carpet to a desired color is placed in the spray tank 12. The carpet has preferably been cleaned so that dirt on the carpet will not interfere with the application to and uniform acceptance of the dyestuff by the carpet.

The solution of the dyestuff in the spray tank 12 is sprayed downwardly into the upwardly extending pile of the carpet. An operator typically uses a back and forth motion of the spray gun 14 as he works his way backward across a section of the carpet. Adjacent sections are similarly sprayed until the entire carpet has been sprayed with the solution of the dyestuff.

To obtain uniform penetration of the dyestuff solution into the pile of the carpet and to avoid over wetting of the carpet, the pressure of the dyestuff solution sprayed from the spray gun 14 and the distance of the nozzle 50 from the pile of the carpet must be carefully controlled. Therefore, the compressor is adjusted so that the liquid in the spray tank 12 is displaced to the spray gun 14 at a pressure of between approximately 40 and 45 pounds per square inch. Higher pressures generally tend to cause over wetting of the carpet and lower pressure result in insufficient application of the dyestuff to the carpet and insufficient penetration of the dyestuff into the pile fibers to obtain uniform dyeing of the pile. Furthermore, the distance of the nozzle 50 from the pile of the carpet must be controlled to achieve uniform dyeing. When the nozzle 50 is too close to the pile, splashing and uneven penetration into the carpet of the dyestuff solution results; when too far, insufficient penetration results. Generally, a distance of approximately eight inches between the pile and the nozzle 50 provides the desired penetration.

It is not necessary to provide special conditions of water temperature for the practice of the present invention. It is specifically contemplated that the present invention may be practiced at water temperatures between approximately 60° and 212° F., specifically at ambient temperatures generally found in homes and buildings where carpet would usually be installed.

In order to assure sufficient penetration and uniform application of the dyestuff solution, it may be necessary to mechanically scrub the pile of the carpet after the dyestuff solution has been sprayed thereon. It has been found that when relatively thick or long carpet pile is treated, scrubbing is often necessary; whereas, carpet with relatively short pile may not require scrubbing. The scrubbing operation can be conveniently performed using a machine, such as those used for buffing and polishing tile or other hard flooring, to rotatably drive a brush attached thereto. Such machines and brushes are well known in the art and are often used for shampooing pile carpeting.

After the dyestuff solution has been applied and optionally scrubbed into the carpet, a sealer is sprayed onto the pile of the carpet to set the dye in the pile. The sealer is conveniently sprayed onto the upper surface of the pile of the carpet in the form of a fog, i.e., liquid mixed with air. The sealer is applied in an amount sufficient to merely cover the surface of the pile. As with the dyeing step, it may be necessary to scrub the sealer into the pile depending on the thickness or length of the pile. Such brushing can be conveniently accomplished by raking the carpet with a shag brush. Sealers used for dyesetting are well known in the art and the particular formulation is not critical to the present invention. A sealer useful in the present invention is Pro Fix NYL made by Professional Chemical & Color, Inc. of Dalton, Georgia.

After the sealer has been sprayed onto the carpet and optionally brushed into the pile, it may be desirable to apply a water repellant material to the pile to improve the stain resistance of the carpet. Water repellant materials are well known in the art and the particular formulation is not critical to the present invention. A water repellant material useful in the present invention is Scotch Guard, which is the trademark of Minnesota Mining and Manufacturing Company of Minneapolis, Minnesota. The water repellant material is applied by spraying onto the surface of the pile in an amount sufficient to provide the desired repellant characteristics to the carpet. As with the previous dye and sealer steps, it may be desirable to scrub the water repellant material into the pile of the carpet. This can be conveniently done by raking the pile with a shag brush. Shag brushes are also well known in the art.

After the dyestuff solution and sealer have been sprayed onto the carpet and optionally brushed in, and optionally after the water repellant has been applied and brushed in, the carpet is permitted to dry.

The dyestuff solution of the present invention is specifically designed to be used in dyeing 100 percent nylon pile carpeting. Dyestuffs useful in the present invention are of the types known in the industry and to those skilled in the art as acid dyes, direct dyes and acid premetallized dyes. The present invention is not limited to any particular dyestuff of the foregoing types, except in that the molecule of the dyestuff must have one or more sulphonic acid reactive groups ($SO_3$) thereon so as to form an ionic bond with the amine group (NH+) of the nylon. The basic chemical reaction which occurs is as follows:

$$R{-}SO_3^- + NH_2{-}(CH_3)_x \rightarrow$$

$$R{-}SO_2{-}NH{-}(CH_3)_x + OH^-$$

wherein, R is either an acid dye, a direct dye or an acid premetallized dye of the anthroquinone, azo, diazo, or 1:1 or 2:1 metal complex types. Specific examples of such dyestuffs useful in the present invention include: C.I. Acid Blue 80, 61585 having the following structure:

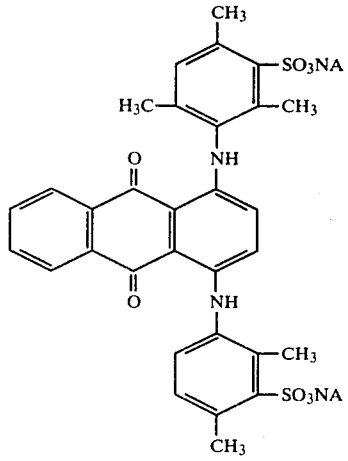

C.I. Direct Orange 18, 20215 having the following structure:

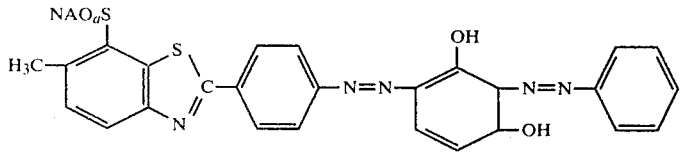

C.I. Acid Violet 78 having the following structure:

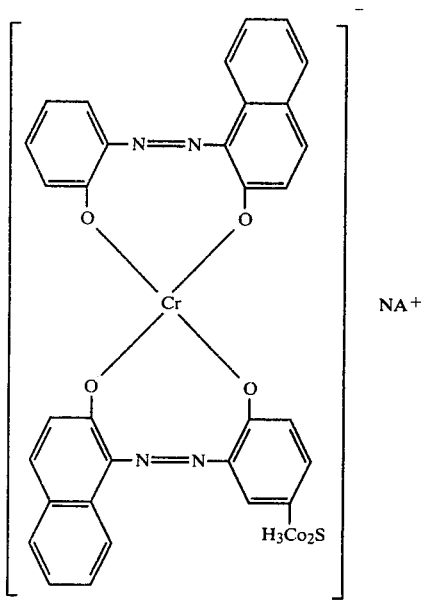

It will therefore be appreciated by those skilled in the art that the chemical nature of the dyestuff is not critical to the present invention as long as it has one or more sulphonic acid groups which will react with the amine group of the nylon.

The dyestuff solution useful in the present invention is made by adding the dyestuff, which is typically a solid powder, to water. To facilitate dissolving of the powder in the water, it is desirable to use hot water, i.e., water at approximately 90° to 120° F. The concentration of the dyestuff in the water may be varied to provide the desired intensity of color in the dyed pile carpet. This provides the basic dyestuff solution.

In order to provide other desirable properties to the basic dyestuff solution certain well known additives can also be provided. In order to facilitate penetration of the dyestuff solution into the pile of the carpet, a penetrant can be added. Penetrants are well known in the art and can be of the ethylene oxide type. A suitable penetrant is Pro Wet 100 made by Professional Chemical & Color, Inc. The amount of penetrant added to the basic dyestuff solution is between approximately 1 and 5 grams per liter of solution with the ratio of dyestuff to penetrant being approximately 2:1.

A leveling agent can be added to the basic dyestuff solution. Leveling agents are well known in the art and can be of the sulfoxylated or hydrocarbon type. A leveling agent useful in the present invention is Pro Lev RAP made by Professional Chemical & Color, Inc. The amount of leveling agent added to the basic dyestuff solution is between approximately 1 and 5 grams per liter of solution.

A defoamer can be added to the basic dyestuff solution. Defoamers are well known in the art and can be of the silicone or alcohol type. A defoamer useful in the present invention is Pro Defoamer S made by Professional Chemical & Color, Inc. The amount of defoamer added to the basic dyestuff solution is approximately 0.5 grams per liter of solution.

The dyeing method of the present invention is substantially independent of pH. The pH of the dyestuff solution useful in the present invention can be between approximately 2.0 and 10.0, preferably between approximately 5.0 and 7.0. Therefore, it may be desirable to add either acid or a buffer solution to the basic dyestuff solution to adjust the pH of the final solution to the desired range. Acids and buffers useful for adjusting the pH of dyestuff solutions are well known in the art.

It should be understood, of course, that the foregoing relates only to a preferred embodiment of the present invention and that numerous modifications or alterations may be made therein without departing from the spirit and scope of the invention as set forth in the appended claims.

We claim:

1. A method of dyeing a tufted nylon pile carpet on location comprising the sequential steps of:

spraying an aqueous solution of a dye liquor downwardly into upwardly extending nylon pile of the carpet, said dye liquor being at a temperature between approximately 60° F. and 212° F., said dye liquor being sprayed from an airless sprayer having a nozzle, said dye liquor being sprayed from said nozzle at a pressure of between approximately 40 and 45 pounds per square inch and said nozzle being approximately eight inches from said pile to provide uniform penetration of said dye liquor into said pile and to avoid overwetting of said carpet;

said dye liquor being selected from the group consisting of:

an aqueous solution of an acid dye having one or more sulphonic acid reactive groups;

an aqueous solution of an acid premetallized dye having one or more sulphonic acid reactive groups; and an aqueous solution of a direct dye having one or more sulphonic acid reactive groups; and brushing the pile of the carpet to assure sufficient penetration and uniform application of said dye liquor into said nylon pile.

2. The method of claim 1 and wherein the step of spraying a dye liquor downwardly into upwardly extending pile of the carpet comprises spraying a dye liquor into a nylon pile, the dye liquor including a sulphonic acid reactive group to cause an ionic bond of the type:

$$R{-}SO_3^- + NH_2{-}(CH_3)_x \rightarrow$$

$$R{-}SO_2{-}NH{-}(CH_3)_x + OH^-.$$

3. The method of claim 1 and wherein said scrubbing is done with a rotary motor driven brush.

* * * * *